US006843428B2

(12) United States Patent
Wooten et al.

(10) Patent No.: US 6,843,428 B2
(45) Date of Patent: Jan. 18, 2005

(54) FOUNTAIN HAVING LIGHTED PORTION

(75) Inventors: David Wooten, Arlington, TX (US); John Walker, Grapevine, TX (US); Michael Wang, Dallas, TX (US)

(73) Assignee: Beckett Corporation, Irving, TX (US)

( * ) Notice: Subject to any disclaimer, the term of this patent is extended or adjusted under 35 U.S.C. 154(b) by 0 days.

(21) Appl. No.: 10/236,818

(22) Filed: Sep. 6, 2002

(65) Prior Publication Data

US 2004/0104282 A1 Jun. 3, 2004

(51) Int. Cl.[7] ..... F21S 8/00

(52) U.S. Cl. ..... 239/20; 239/17; 239/18; 239/23; 239/211; 362/96

(58) Field of Search ..... 239/16, 17, 18, 239/20, 22, 23, 211; 362/96, 806, 101; 40/406

(56) References Cited

U.S. PATENT DOCUMENTS 1,549,204 A 8/1925 Merigold
2,572,379 A * 10/1951 Pearse ..... 239/20
3,071,326 A * 1/1963 Benak ..... 239/20
3,542,292 A 11/1970 chase
3,702,172 A 11/1972 Hawkins
3,912,166 A * 10/1975 Chatten ..... 239/20
4,281,794 A 8/1981 Dimino
5,571,409 A * 11/1996 Scarborough ..... 210/169
6,416,197 B1 * 7/2002 Chang ..... 362/96
6,439,471 B2 * 8/2002 Ehrlich et al. ..... 239/18

* cited by examiner

*Primary Examiner*—Steven J. Ganey
(74) *Attorney, Agent, or Firm*—Gardere Wynne Sewell LLP

(57) ABSTRACT

A fountain having a substantially-rectangular fountain body having a dividing floor disposed horizontally therein, dividing the fountain body into a lower chamber open on its bottom end and an upper chamber open on its top end. A conduit, passing through the dividing floor, connects the lower chamber to the upper chamber. A light source is disposed in the lower chamber. A pump, disposed within the upper chamber, pumps water up to a water spout disposed above it, which is returned to the pump by the force of gravity.

22 Claims, 7 Drawing Sheets

FOUNTAIN HAVING LIGHTED PORTION

FIELD OF THE INVENTION

The present invention relates generally to fountains and more specifically to a fountain having a lighted portion.

BACKGROUND OF THE INVENTION

The basic combination of a light and a fountain is not new. In one known design, a lighted water globe has a base including a lamp, a music box, a light altering wheel, and a power supply. Above the base, there is a sealed glass dome filled with water. A bundle of fiber optic elements is disposed inside the glass dome, in addition to decorative objects such as flowers. When the power supply is activated, the lamp projects light on the light-filtering wheel, which filters the light into a range of colors.

The colors from the light-filtering wheel are directed through the fiber optic elements in order to produce colorful visual effects. While the mechanical music box generates music, a shaft drives the lighted water globe to revolve relative to a support stand.

In another design, a fountain water lamp consists of a transparent unit, a base, a driving unit, a color disk, a light source unit, a circuit board, a water pump unit and an air pump unit. When the light source unit generates light and projects on the transparent film of the color disk, colored light is projected onto the transparent unit.

In the above design, an air pump delivers air into the transparent unit, generating air bubbles which bob and escape through the fluid in a random, scattered manner. The liquid contained in the transparent unit overflows into a spill channel, and from the spill channel to a multi-layer passage. The water is then drawn and pumped back up to the transparent unit in continuous circulation.

SUMMARY OF THE INVENTION

In one embodiment, the present invention is a fountain having a lower chamber having a light source disposed therein and an upper chamber, disposed above the lower chamber, having a pump operably connected to a water spout.

In a second embodiment, the present invention is a fountain having a substantially-rectangular lower chamber having a light source disposed therein and a substantially-rectangular upper chamber, disposed above the lower chamber, having a pump operably connected to a water spout disposed above the pump.

In a third embodiment, the present invention is a fountain having a substantially-rectangular fountain body having a dividing floor disposed horizontally therein, dividing the fountain body into a lower chamber and an upper chamber. A light source is disposed in the lower chamber, while a pump is disposed within the upper chamber. A spout is disposed above the pump and the upper chamber and a water tube connects the pump to the spout.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention and do not delimit the scope of the invention.

Figure 1:
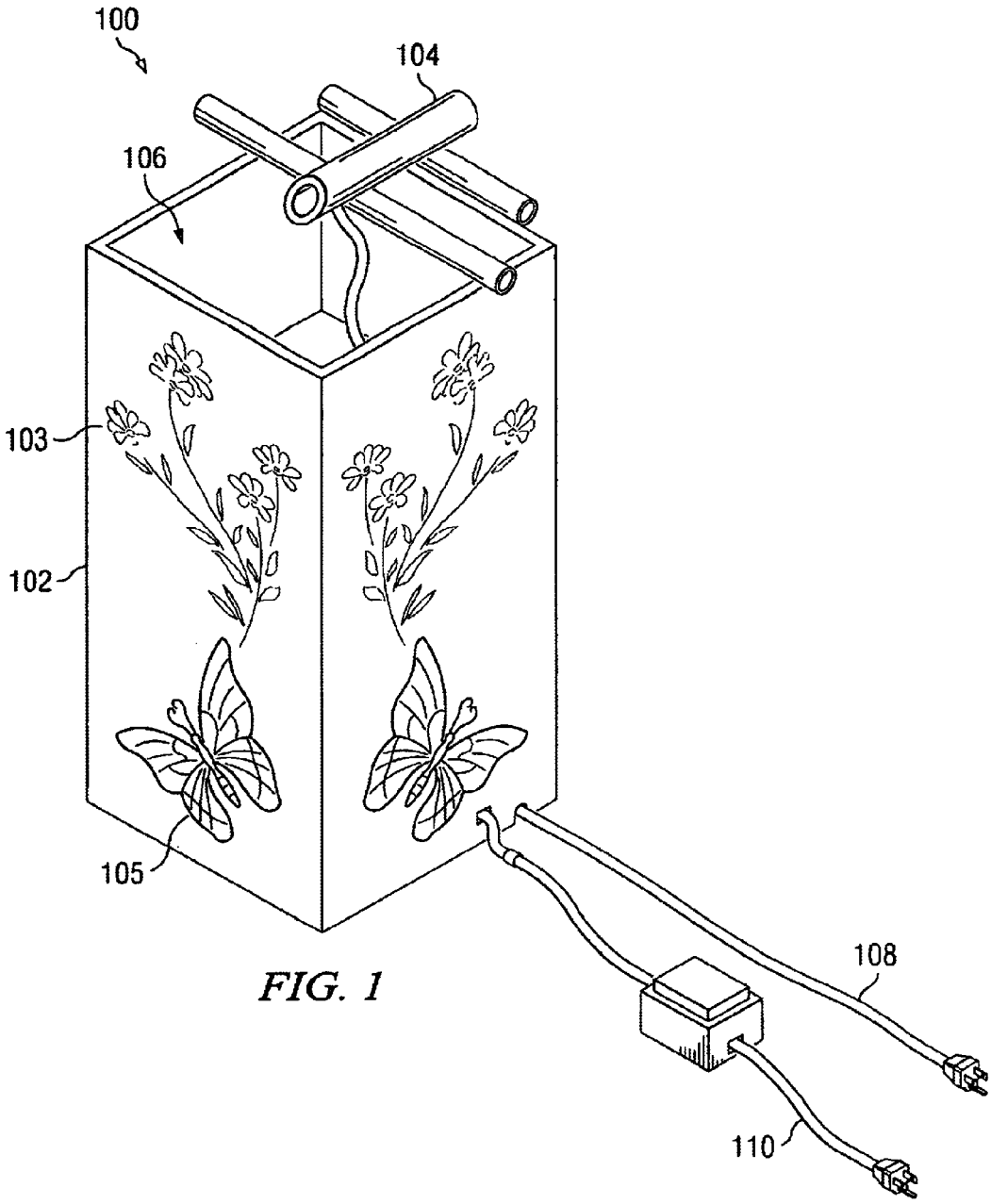
FIG. 1 depicts an isometric view of a lighted fountain in accordance with one embodiment of the present invention.
Figure 6:
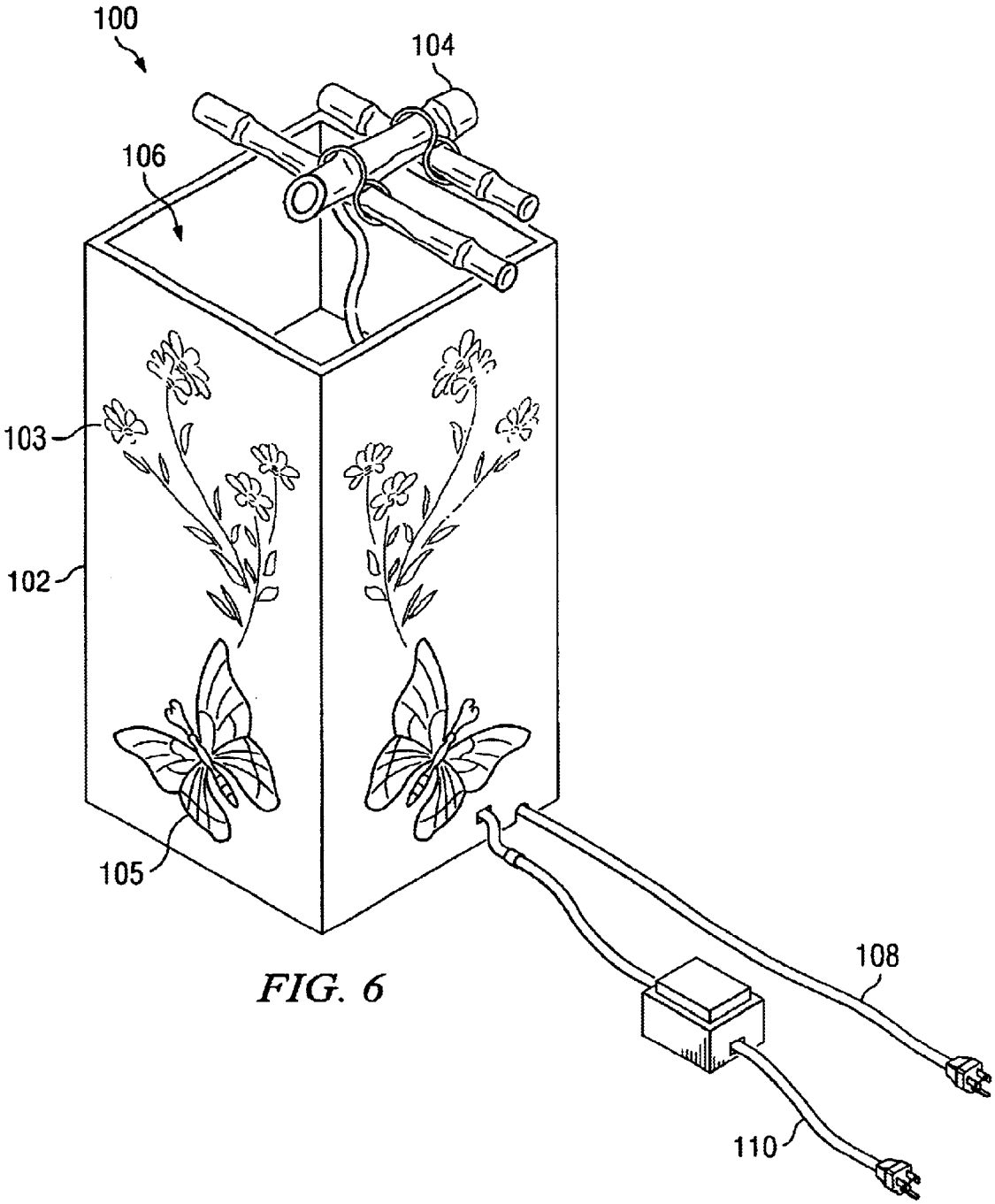
FIG. 6 depicts a lighted fountain with a feature of a spout shaped as a piece of bamboo in accordance with one embodiment of the present invention.
Figure 7:
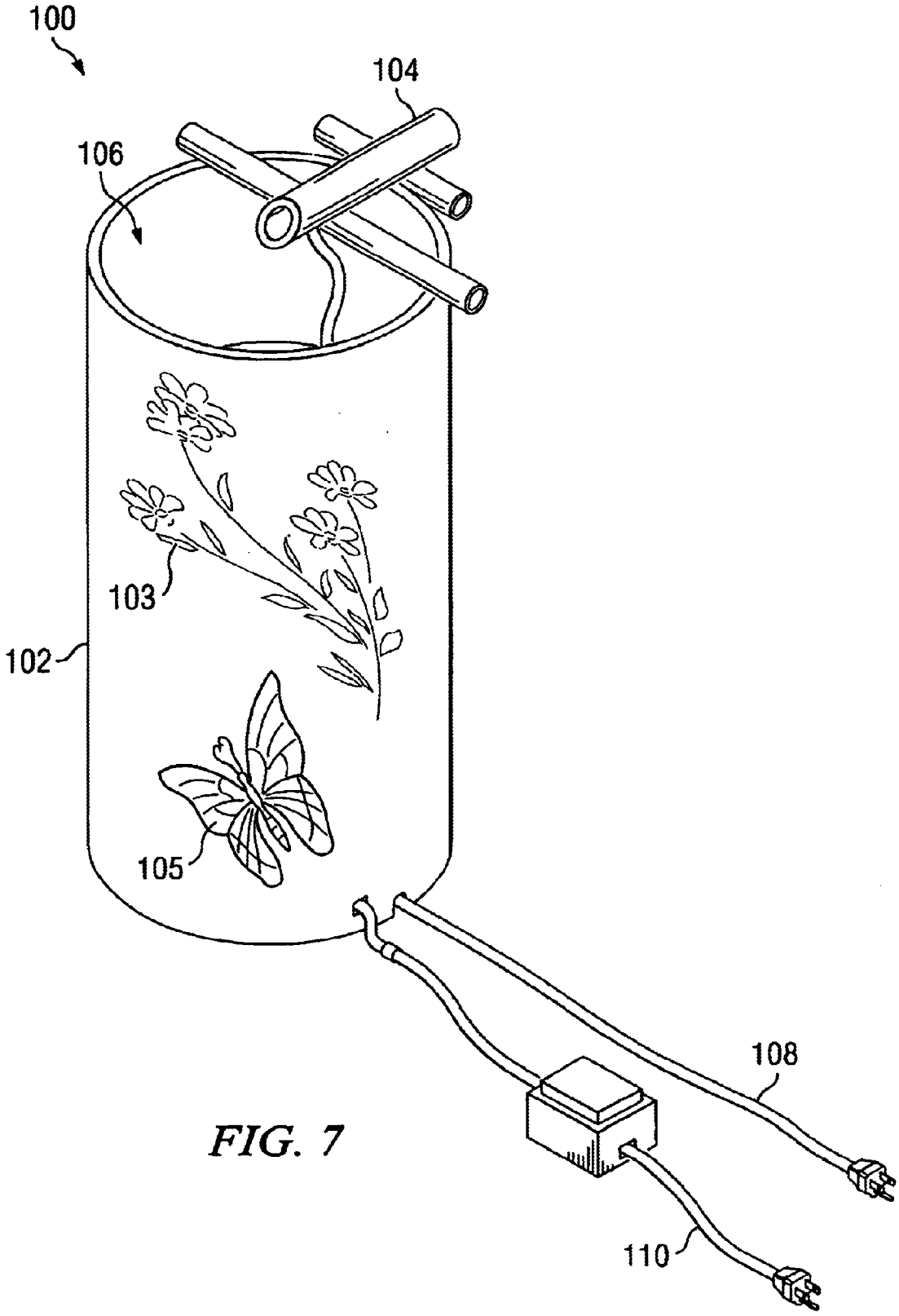
FIG. 7 depicts a lighted fountain with a circular shape in accordance with one embodiment of the present invention.

FIG. 1 depicts an isometric view of a lighted fountain 100 in accordance with one embodiment of the present invention. As seen in FIG. 1, lighted fountain 100 includes a fountain body 102 having a spout 104 disposed on the top thereof in such a manner as to direct water into the upper chamber 106 of the fountain body 102. Lighted fountain 100 also includes a pair of power cables 108 and 110 for connecting lighted fountain 100 to an electrical power source (not shown). The fountain body 102 may have a relief 103 or a decorative pattern 105 disposed on the surface and may be of polygonal shapes, such square (FIG. 1) or circular (FIG. 7), as examples. The spout 104 may, for example, be shaped as a piece of bamboo (FIG. 6).

Figure 2:
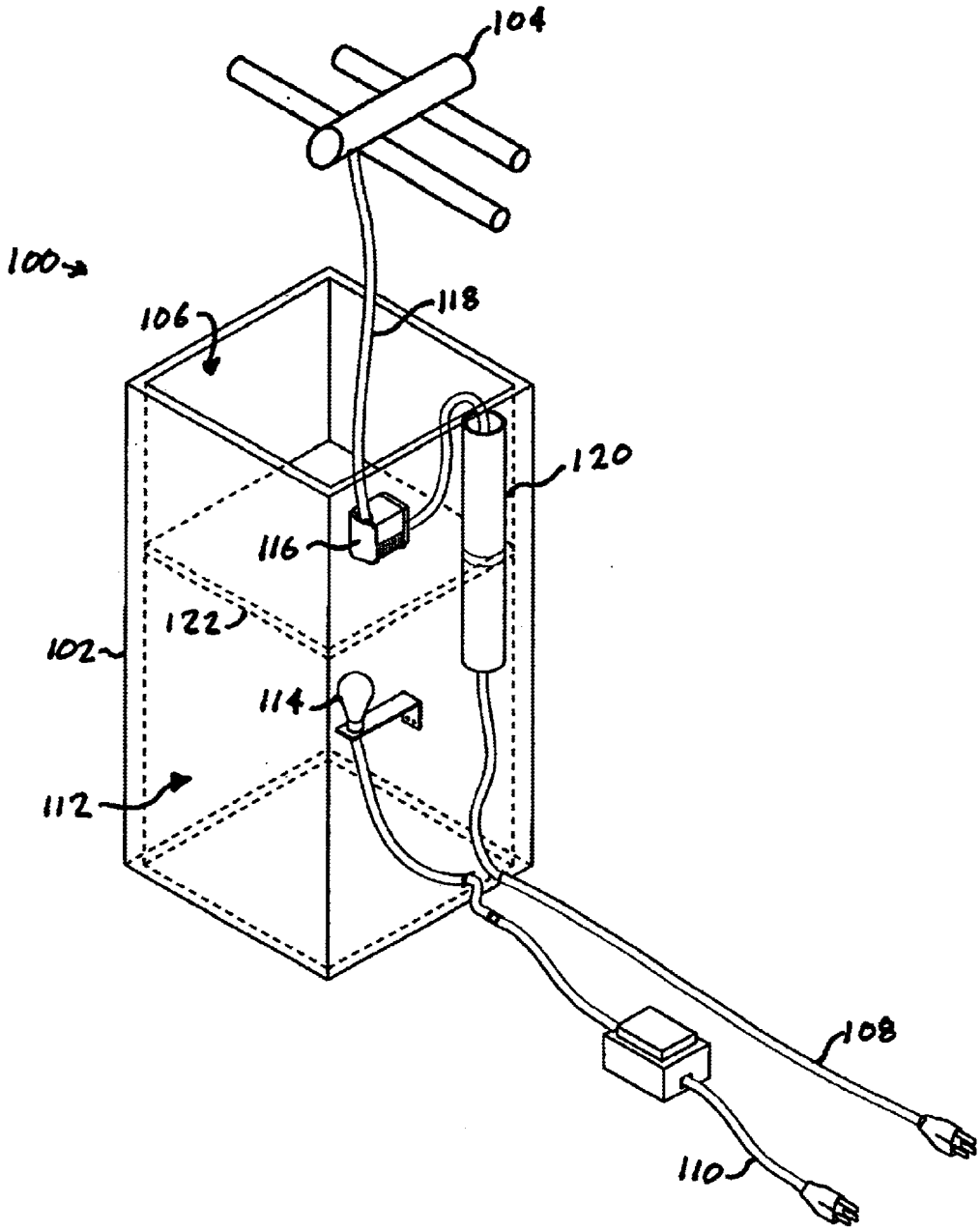
FIG. 2 depicts a shadowed isometric view of the lighted fountain of FIG. 1.

FIG. 2 depicts a shadowed isometric view of the lighted fountain 100 of FIG. 1. In addition to the features already described in connection with FIG. 1, a number of additional features can be more clearly seen in FIG. 2.

In addition to upper chamber 106, fountain body 102 includes a lower chamber 112. Disposed within lower chamber 112 is a light source 114, which can be connected to an electrical power source by power cable 110. Disposed within upper chamber 106 is a water pump 116, which is connected to water spout 104 by a water tube 118. Water pump 116 is connected to an electrical power source by power cable 108, which passes from lower chamber 112 to upper chamber 106 through conduit 120. Connected and powered in this way, water pump 116 provides a continuous flow of water from the lower portion of upper chamber 106, through water pump 116, water hose 118, and water spout 104, in that order. Water exiting from water spout 104 returns by gravity to the lower portion of upper chamber 106.

Except for the connection provided by conduit 120, upper chamber 106 and lower chamber 112 are completely segregated by dividing floor 122. In this embodiment, dividing floor 122 is designed to seal the bottom portion of upper chamber 106 against the leakage of water from upper chamber 106 into lower chamber 112.

Figure 3:
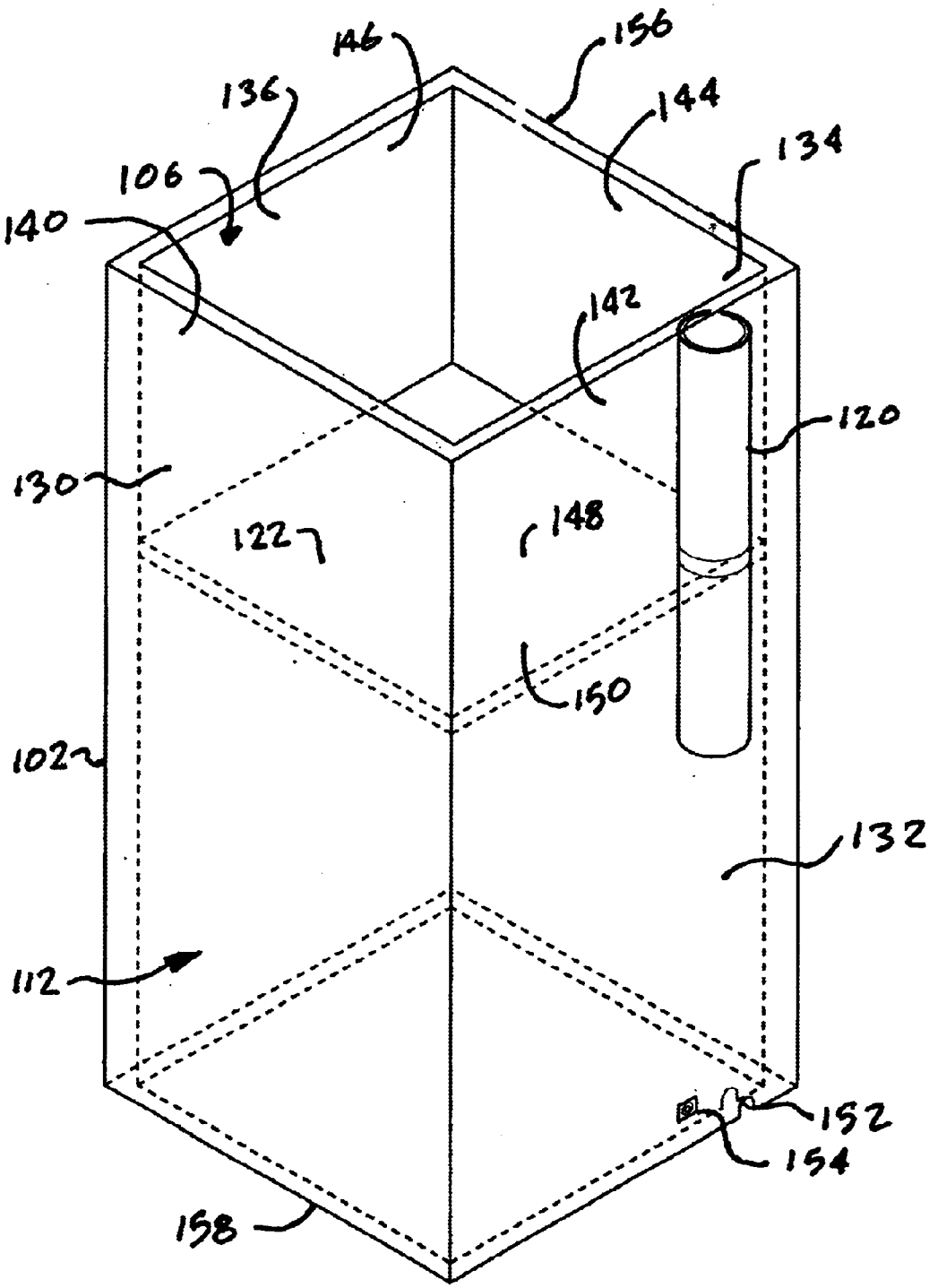
FIG. 3 depicts a shadowed isometric view of the body of the lighted fountain of FIG. 1.

FIG. 3 depicts a shadowed isometric view of the fountain body 102 of the lighted fountain 100 of FIG. 1. Fountain body 102 principally incorporates an upper chamber 106 and a lower chamber 112, separated by a dividing floor 122.

The outer surface of fountain body 102 is principally defined by four substantially-planar and substantially-vertical external surfaces 130, 132, 134, and 136. In the embodiment shown in FIGS. 1-3, each of the four external surfaces 130–136 is disposed at approximately 90 degrees to the surfaces adjacent to it. In other words, each of the four external surfaces 130–136 is disposed substantially normally to the surfaces adjacent to it.

The inner surface of fountain body 102 is formed by four substantially-planar and substantially-vertical external surfaces 140, 142, 144, and 146. In the embodiment shown in FIGS. 1-3, each of the four internal surfaces 140–146 is disposed at approximately 90 degrees to the surfaces adjacent to it. In other words, each of the four internal surfaces 140–146 is disposed substantially normally to the surfaces adjacent to it.

The inner volume defined by internal surfaces 140–146 is segregated into upper chamber 106 and lower chamber 112 by dividing floor 122, which has a substantially-planar upper surface 148 and a substantially-planar lower surface 150. Disposed at or near the bottom of the fountain body 102 is a pair of passages 152 and 154, to allow for the passage of electrical power cables 108 and 110 from the exterior to the interior of fountain body 102. The uppermost portion of exterior surfaces 130–136 and interior surfaces 140–146 is defined by upper flange 156, while the lowermost portion of exterior surfaces 130–136 and interior surfaces 140–146 is defined by lower flange 158.

In various embodiments, surfaces 130–136 and 140–146 and dividing floor 122 may have varying levels of light transmissibility. Dividing floor 122, for example, may be completely opaque, completely transparent, or translucent to some degree. It may also be transparent and tinted, and it may have one or more decorative patterns disposed thereon. Similarly, any of surfaces 130–136 and 140–146 may be transparent, opaque, or translucent, and may also be tinted and/or have one or more decorative patterns disposed thereon.

Varying embodiments of the present invention may incorporate surfaces 130–136 and 140–146 having light-transmissibility characteristics in any combination without departing from the spirit and scope of the present invention. In one embodiment, as an example, dividing floor 122 is transparent, while surfaces 130–136 and 140–146 are translucent. This design provides for a relatively uniform level of light within the body 102 of the lighted fountain 100, while providing the illusion that the lighted fountain 100 is filled with water.

Figure 4:
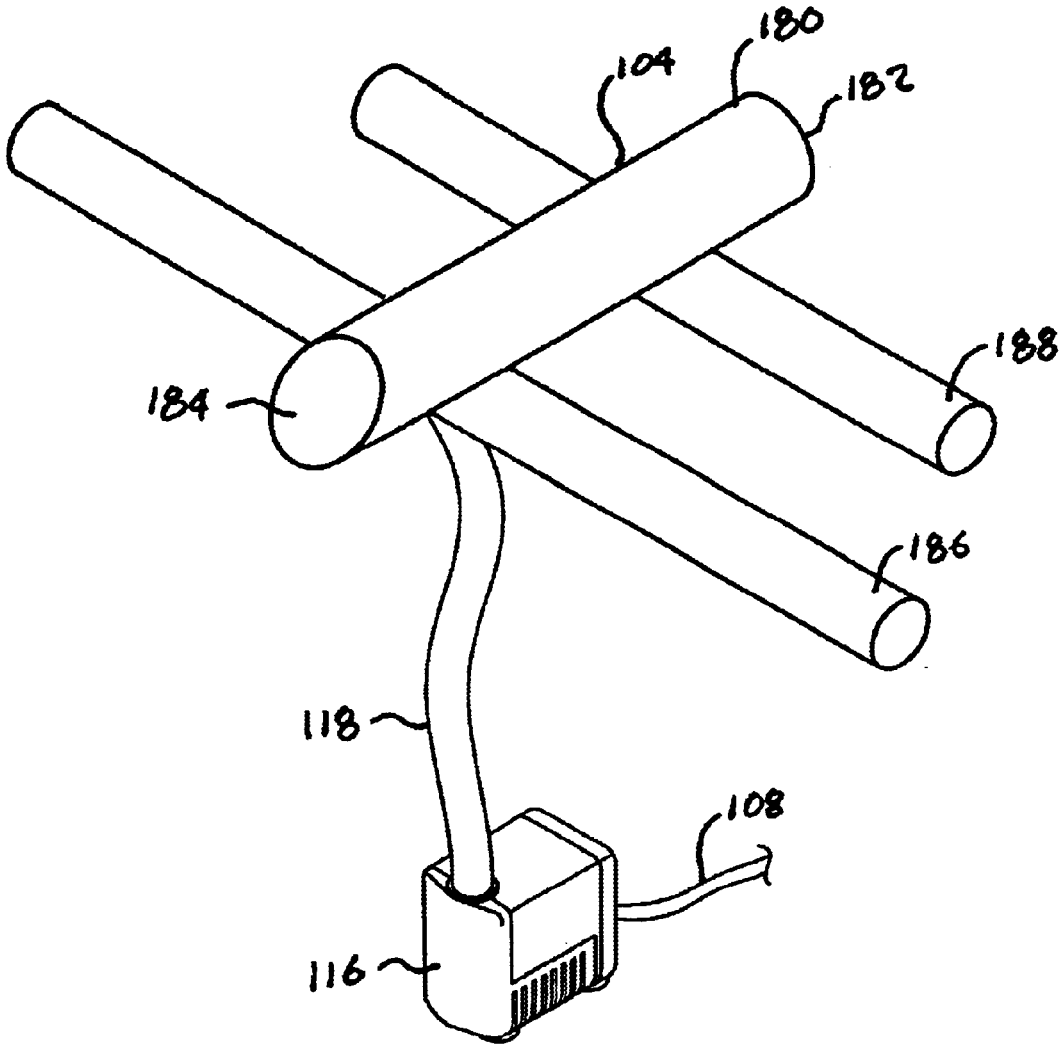
FIG. 4 depicts an isometric view of the pump and spout subassembly of the lighted fountain of FIG. 1.

FIG. 4 depicts an isometric view of the subassembly of the water pump 116, water tube 118 and water spout 104 of the lighted fountain 100 of FIG. 1. Water pump 116 receives electrical energy from a power source via power cable 108. Water pump 116 converts the electrical energy received through power cable 108 into mechanical energy, which is imparted to water passing therethrough, in order to raise the water against the force of gravity, through water tube 118 and into an interior portion of water spout 104.

Water spout 104 includes a generally-cylindrical main tube 180 having a rear end 182 and a front end 184. In the embodiment shown in FIG. 4, water exits the main tube 180 through front end 184, but other designs may employ alternate exit schemes, depending on the application. Main tube 180 is supported by a pair of generally-cylindrical support tubes 186 and 188.

Water exiting water pump 116 passes through water tube 118, through the bottom of water spout 104 into an interior portion of main tube 180 of water spout 104. Water entering the main tube 180 is then drawn out the front end 184 of the main tube 180 by the force of gravity.

Figure 5:
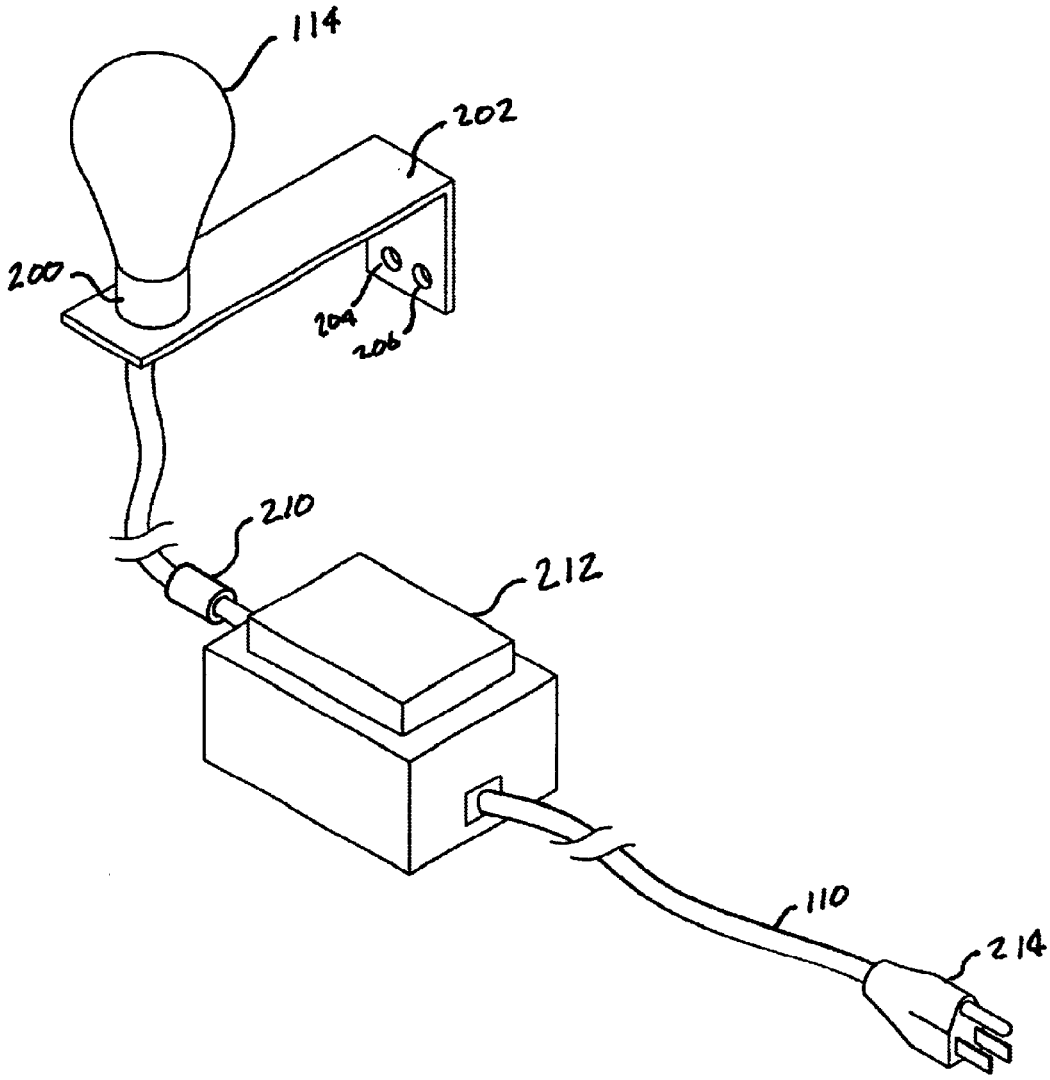
FIG. 5 depicts an isometric view of the lighting subassembly of FIG. 1.

FIG. 5 depicts an isometric view of the lighting subassembly of the lighted fountain 100 of FIG. 1. Lighting within the body of lighted fountain 100 is principally accomplished by the use of a light source 114 mounted in a receptacle 200 mounted on a light source bracket 202. Light source bracket 202 is mounted to a surface of the lighted fountain 100 using fastener holes 204 and 206.

Light source 114 receives electrical energy through power cable 110, which may incorporate a noise filter 210 and/or a voltage converter 212. Power cable 110 terminates in a plug 214, which may be designed with a pair of parallel blades suitable for connection to a standard United States 110-volt residential outlet. Plug 214 may also incorporate a cylindrical grounding lug. Voltage converter 212 may incorporate a circuit for reducing or increasing the voltage received from the power source, and may also incorporate a circuit for rectifying and conditioning an alternating current into a direct current, or vice versa.

Although preferred embodiments of the invention have been described in detail, it will be understood by those skilled in the art that various modifications can be made therein without departing from the spirit and scope of the invention as set forth in the appended claims.

What is claimed is:

1. A fountain comprising:

a fountain body having a divider, the divider segregating the fountain body into a lower chamber and a waterproof upper chamber;

a light source disposed in the lower chamber; and a self-contained electrically-powered submersible pump disposed in its entirety within the upper chamber; and a water spout disposed above the upper chamber and operably connected to the pump.

2. The fountain of claim 1 wherein the fountain body is colored.

3. The fountain of claim 1 wherein the fountain body is frosted.

4. The fountain of claim 1 wherein the fountain body has a surface selected from the group consisting of a decorative pattern, a relief, and combinations thereof.

5. The fountain of claim 1 wherein all or portions of the surface are light transmitting.

6. The fountain of claim 1 further comprising a water tube connecting the water pump to the spout.

7. The fountain of claim 1 wherein the fountain body has a polygonal shape.

8. The fountain of claim 1 wherein the fountain body has a circular shape.

9. The fountain of claim 7, wherein the polygonal shape is square.

10. The fountain of claim 1 wherein the divider comprises a transparent polyresin basin.

11. The fountain of claim 1 wherein the spout has a decorative shape.

12. The fountain of claim 1 wherein the spout is shaped as a piece of bamboo.

13. A fountain comprising:

a substantially-rectangular fountain body having a divider, the divider segregating the fountain body into a substantially-rectangular lower chamber and a waterproof, substantially-rectangular upper chamber;

a light source disposed in the lower chamber; and a submersible pump disposed within the upper chamber; and a water spout disposed above the upper chamber and operably connected to the pump.

14. A fountain comprising:

a substantially-rectangular fountain body having a dividing floor disposed horizontally therein, dividing the fountain body into a substantially-rectangular lower chamber and a substantially-rectangular waterproof upper chamber;

a light source disposed in the lower chamber;

a pump disposed within the upper chamber;

a spout disposed above the pump and the upper chamber; and a water tube connecting the pump to the spout.

15. A fountain comprising:

a substantially-rectangular fountain body having a dividing floor disposed horizontally therein, dividing the fountain body into a lower chamber open on its bottom end and an upper chamber open on its top end;

a conduit, passing through the dividing floor, thereby connecting the lower chamber to the upper chamber;

a light source disposed in the lower chamber; and a pump disposed within the upper chamber;

a spout disposed above the pump and the upper chamber; and a water tube connecting the pump to the spout.

16. A fountain comprising:

a fountain body having a square shape and a divider, the divider segregating the fountain body into a lower chamber and a waterproof upper chamber;

a light source disposed in the lower chamber; and a submersible pump disposed within the upper chamber; and a water spout disposed above the upper chamber and operably connected to the pump.

17. The fountain of claim 15, wherein portions of the fountain body and the divider are light transmitting.

18. A fountain comprising:

a fountain body having circular shape and a divider, the divider segregating the fountain body into a lower chamber and a waterproof upper chamber;

a light source disposed in the lower chamber; and a submersible pump disposed within the upper chamber; and a water spout disposed above the upper chamber and operably connected to the pump.

19. The fountain of claim 18, wherein portions of the fountain body and the divider are light transmitting.

20. A fountain comprising:

a fountain body having polygonal shape and a divider, the divider segregating the fountain body into a lower chamber and a waterproof upper chamber;

a light source disposed in the lower chamber; and a submersible pump disposed within the upper chamber; and a water spout disposed above the upper chamber and operably connected to the pump.

21. The fountain of claim 20, wherein portions of the fountain body and the divider are light transmitting.

22. A fountain comprising:

a fountain body having a divider and side walls, the divider segregating the fountain body into a lower chamber and a waterproof upper chamber and side walls having light transmitting portions;

a light source disposed in the lower chamber; and a self-contained electrically-powered submersible pump disposed in its entirety within the upper chamber; and a water spout with a decorative surface disposed above the upper chamber and operably connected to the pump.

* * * * *